United States Patent [19]

Ogawa et al.

[11] Patent Number: 4,932,875

[45] Date of Patent: Jun. 12, 1990

[54] MULTIPOLAR CONNECTOR

[75] Inventors: Sumitaka Ogawa; Kouji Kano, both of Saitama, Japan

[73] Assignee: Honda Giken Kogyo Kabushiki Kaisha, Tokyo, Japan

[21] Appl. No.: 369,832

[22] Filed: Jun. 22, 1989

[30] Foreign Application Priority Data

Jun. 24, 1988 [JP] Japan ..... 63-88163[U]

[51] Int. Cl.[5] ..... H01R 19/60

[52] U.S. Cl. ..... 439/271

[58] Field of Search ..... 439/271-276

[56] References Cited

U.S. PATENT DOCUMENTS

| | | | |
|---|---|---|---|
| 3,678,441 | 7/1972 | Upstone et al. | 439/272 |
| 4,260,966 | 4/1981 | Boutros | 439/271 |
| 4,824,390 | 4/1989 | Crane et al. | 439/271 |

*Primary Examiner*—Joseph H. McGlynn

[57] ABSTRACT

A multipolar connector includes a female connector having a female housing for accommodating and supporting a plurality of first connecting terminals, a male connector having a male housing for accommodating and supporting a plurality of second connecting terminals each connectable to a corresponding one of the first connecting terminals. A seal member is positioned between opposing end faces of the female and male connectors when the female and male connectors are coupled with each other. Overlapping portions are formed between individual connecting terminals on the end faces of the female and male housings opposing through the seal member and overlapping portions are formed on the seal member for intimate contact engagement with the overlapping portions on said female and male housings.

9 Claims, 2 Drawing Sheets

MULTIPOLAR CONNECTOR

BACKGROUND OF THE INVENTION

1. Field of the Invention

This invention relates to a multipolar connector useful for connecting a plurality of electric circuits. More particularly, to an improvement in a multipolar connector which is composed of a female connector having a female housing for accommodating and supporting a plurality of first connecting terminals, a male connector having a male housing for accommodating and supporting a plurality of connecting terminals each connectable to corresponding first connecting terminals, and a seal member inserted between the opposing end faces of the female and male housings when the female and male connector are coupled with each other.

2. Description of Background Art

A conventional multipolar connector is disclosed in Japanese Laid-Open Utility Model Application No. 58-131576.

SUMMARY AND OBJECTS OF THE INVENTION

In the conventional multipolar connector, the seal member between the female and male connectors consist of a flat shape with extremely short surface distances between the individual connecting terminals. Therefore, when exposed to water, it is likely that water may creep into a gap formed between the coupled connectors and reach the connecting terminals by passing a seal portion of the seal member. If this occurs, an unnecessary circuit connection is completed between the connecting terminals.

In accordance with the present invention, a multipolar connector is provided which is characterized by the provision of apertures and protuberances formed between individual connecting terminals on the end faces of the female and male housings opposing each other through a seal member. The protuberances and apertures formed on the seal member intimately engage with the apertures and protuberances formed on the housing end faces.

With the above-described configuration, the apertures and protuberances formed on the opposite end faces of the female and male housings contribute to lengthen the surface distances between the individual connecting terminals in cooperation with the intimately engaging protuberances and apertures of the seal member. Accordingly, the insulation between the individual connecting terminals is reliably improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
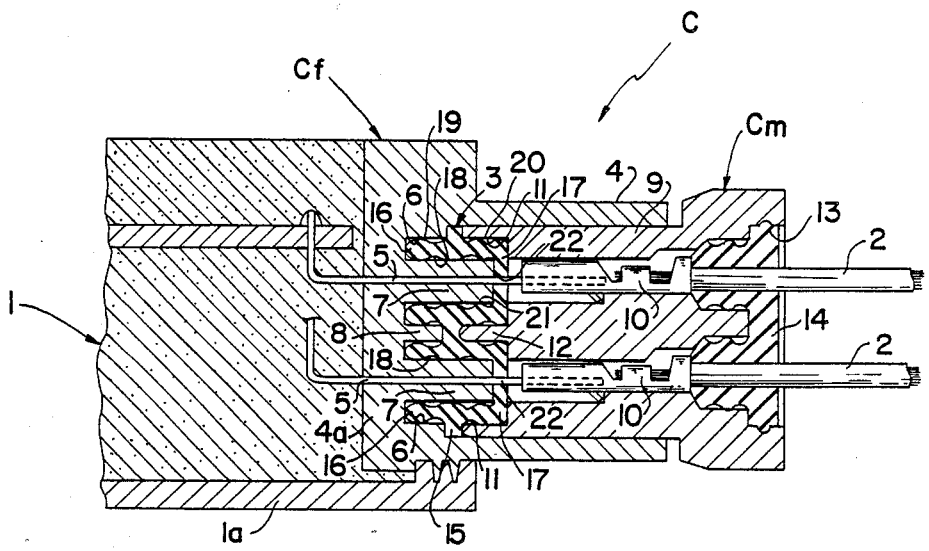
FIG. 1 is a vertically sectioned side view of the multipolar connector according to the present invention.
Figure 2:
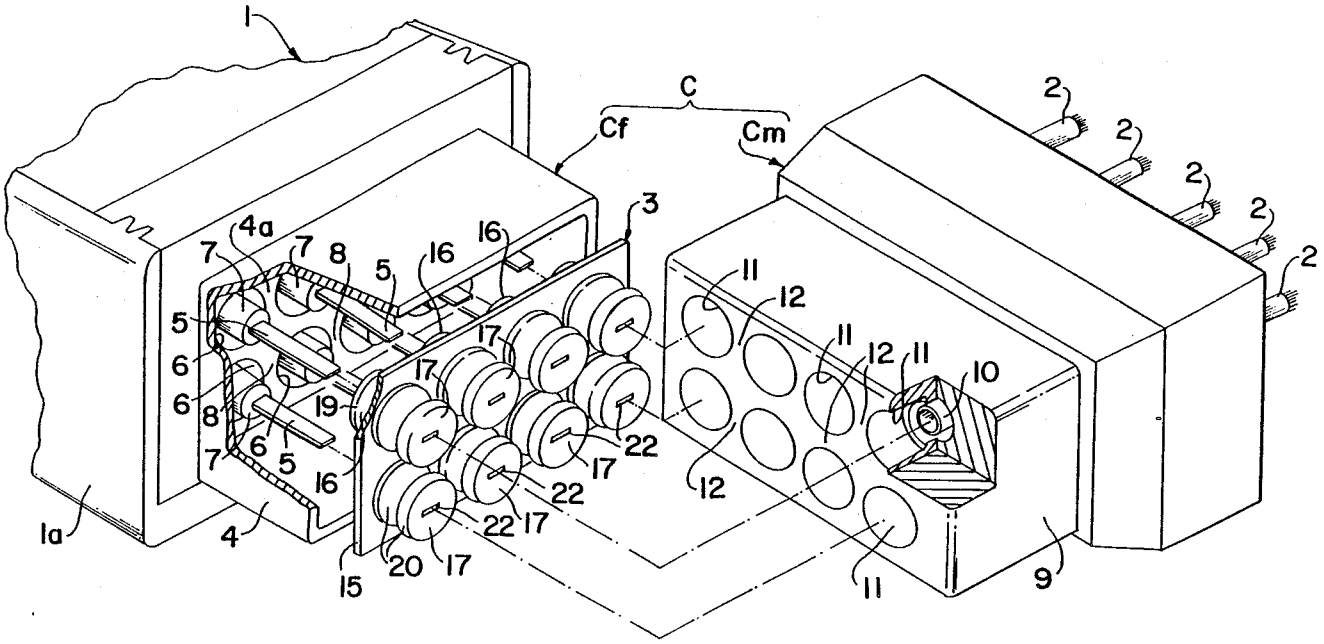
FIG. 2 is an exploded perspective view.

Hereafter, a preferred embodiment of the invention is described with reference to the drawings. A number of wires 2 are connected to one side of an electric control unit 1 through a multipolar connector C.

The multipolar connector C is composed of a female connector Cf on the side of the electric control unit 1, a male connector Cm on the side of the wires 2, and a seal member 3 to be inserted between the opposing end faces of the two connectors Cf and Cm.

The female connector Cf includes a female housing 4 having a bottom wall 4*a* fastened to casing 1*a* of the electric control unit 1. A large number of male terminals 5, first connecting terminals, are accommodated and supported in the female housing 4. On the inner surface, the bottom wall 4*a* of the female housing 4 is provided with upper and lower circular apertures 6 which are arranged in a large number of arrays in the horizontal direction. Circular bosses 7 are provided which rise from the centers of the bottom walls of the respective circular apertures 6 to a level above the apertures. The male terminals 5 extend through the bosses 7 and are securely connected to predetermined electrical circuits. Thus, the apertures 6, partition walls 8, between adjacent apertures 6, and bosses 7 form the aforementioned apertures and protuberances between the individual male terminals 5.

On the other hand, the male connector Cm which is fittingly engageable in the female housing 4 includes a male housing 9, and female terminals 10, second connecting terminals, accommodated and supported in the male housing 9. The male housing 9 is provided with a large number of circular apertures 11 on a front surface for fitting engagement with the fore end portions of the bosses 7. Socket portions of the female terminals 10 are located at the centers of the respective circular apertures 10. Thus, the apertures 11 and partition walls 12 between adjacent circular apertures 11 form the apertures and protuberances between the individual female terminals 10.

The female terminals 10 are connected to the aforementioned wires 2 at rear ends opposite the receptacles. A grommet assembly is fitted in an opening 13 formed on the back side of the male housing 9 for wire withdrawal.

The seal member 3 is a molding of a resilient rubber-like material. The seal member 3 is composed of a plate-like seal body 15 to be gripped between the opposing end faces of the two housings 4 and 9. A large number of first protuberances 16 project or rise from one side of the seal body 15 for intimate engagement with the apertures 6 on the female housing 4. A large number of second protuberances 17 project or rise from the other side of the seal body 15 for intimate engagement with the apertures 11 on the male housing 9. The first protuberances 16 are provided with a large number of circular apertures 18 for intimate engagement with the above-described bosses 7. The first and second protuberances 16 and 17 are each provided with an annular sealing ridge 21 on the inner periphery, which intimately contacts the circumferential surface of the boss 7. The first and second protuberances 16 and 17 are each provided with an annular sealing ridge 20 on the outer periphery, which intimately contacts the circumferential surface of the aperture 11. Further, each one of the second protuberances 17 is centrally provided with a bore 22 for passing a corresponding male terminal 5 therethrough. Thus, the first and second protuberances 16 and 17 and the flat portions of the seal body 15 form the apertures and protuberances on the seal member 3.

The interference of the first protuberances 16 by the apertures 6 of the female housing 4 is present at a value larger than the interference of the second protuberances 17 by the apertures 11 of the male housing 9.

This embodiment is used in the manner as follows. For coupling the female and male connectors Cf and Cm, the seal member 3 is firstly fitted in the female housing Cf. More specifically, the first protuberances 16 and apertures 18 of the seal member 3 are fittingly engaged with the apertures 6 and bosses 7 of the female housing 4, overlaying the seal member 3 on the bottom wall 4a of the housing 4. Whereupon, the male terminals 5 are passed through the bores 22, with their intermediate portions circumvented by the first and second protuberances 16 and 17.

Thereafter, the male housing 9 is fitted into the female housing 4 until its fore end face is abutted against the seal body 15. By so doing, the corresponding male and female terminals 5 and 10 are coupled with each other, while the second protuberances 17 are tightly fitted in the apertures 11 of the male housing 9.

By coupling the female and male connector Cf and Cm in this manner, the wires 2 are connected to the electric control unit 1.

If the coupled multipolar connector C is exposed or covered with water and even if water enters the gap between the coupled housings 4 and 9, intrusion of water into the apertures 6 and 11 is prevented by the first and second protuberances 16 and 17 which circumvent the male terminals 5. In addition, the sealing ridges 19 and 20 are in intimate engagement with the inner peripheral surfaces of the apertures 6 and 11 of the two housings 4 and 9 and also act to prevent the intrusion of water.

Further, if water intrudes as far as the male terminals past the seal portions of the seal member 3, an unnecessary circuit connection is prevented by the high insulation which is provided, on the part of the female housing 4, by the apertures, partition walls 8 and bosses which lengthen the surface distances between the individual male terminals 5 in cooperation with the seal member 3. In addition, the male housing 9, the apertures 11 and partition walls 12 lengthen the surface distances between the individual male terminals in cooperation with the seal member 3 to prevent an unnecessary circuit connection.

Since the first and second protuberances of the seal member 3 are clamped in radial directions by the inner peripheries of the apertures 6 and 11 for sealing purposes, the reaction forces act to hold the female and male connectors Cf and Cm securely in a coupled state due to the strong frictional forces between the protuberances 16 and 17 and the apertures 6 and 11. The reaction forces do not act to separate the two housings 4 and 9 away from each other.

The two connectors Cf and Cm can be uncoupled simply by drawing the male housing 9 out of the female housing 4. In such a case, the seal member 3 is disengaged from the main housing 9 and retained in position in the female housing 4. The interference of the apertures 6 by the first protuberances 16 of the seal member 3 is greater than the interference of the apertures 11 by the second protuberances 17 as mentioned hereinabove.

It will be appreciated from the foregoing description that, according to the present invention, the female and male housings are provided with apertures and protuberances between individual terminals on their opposing end faces which are engaged with each other through a seal member. The protuberances and apertures are intimately engageable with apertures and protuberances formed on the seal member in such a manner as to increase the surface distances between the connecting terminal on the respective housings to enhance the insulation capacity. Therefore, it is possible to prevent unnecessary circuit connection between connecting terminals if intruding water reaches as far as the connecting terminals past a seal portion of the seal member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A multipolar connector including a female connector having a female housing for accommodating and supporting a plurality of first connecting terminals, a male connector having a male housing for accommodating and supporting a plurality of second connecting terminals each connectable to a corresponding one of said first connecting terminals, and a seal member positioned between opposing end faces of said female and male connectors when said female and male connectors are coupled to each other, characterized in that said multipolar connector comprises:

an overlapping portion formed between and around individual connecting terminals on the end face of each of said female and male housings opposing each other through said seal member; and an overlapping portion formed on said seal member and intimately engageable with said overlapping portions on said female and male housings in an overlapped state when said female connector is coupled to said male connector.

2. A multipolar connector according to claim 1, wherein said overlapping portions on said female and male housings are protuberances and apertures and said overlapping portions on said seal member are apertures and protuberances wherein corresponding protuberances and apertures of said female and male housings intimately contact corresponding apertures and protuberances of said seal member when said female connector is coupled to said male connector.

3. A multipolar connector according to claim 2, wherein said protuberances include an annular sealing ridge disposed around an outer peripheral surface thereof.

4. A multipolar connector according to claim 2, wherein said protuberances include an annular sealing ridge disposed around an inner peripheral surface thereof.

5. A waterproof electrical connector including a socket housing accommodating a plurality of contacts, a plurality of pin connectors adapted to be connected to corresponding contacts, a pin connector housing accommodating a plurality of pin terminals formed with recesses fittingly engageable with said socket housing, and a seal member adapted to fit in a gap formed between peripheral surfaces of said socket housing and said connector housing when said socket and said pin connector are coupled with each other, sealing off said pin terminals and said contacts as a whole against intrusion of water, characterized in that:

said socket housing includes cylindrical contact receptacle walls for circumventing the respective contacts installed thereon; and said seal member is positioned around said contact receptacle walls thereby sealing off the adjacent contacts and pin terminals independently of each other when said pin connector and said socket are coupled with each other.

6. A waterproof electrical connector as defined in claim 5, wherein said seal member comprises a unitary structure containing a plurality of seal portions to be fitted on said cylindrical socket receptacle walls for sealing the connected contacts and pin terminals independently of each other when said pin connector and said socket are coupled with each other, said unitary structure having the fore end and peripheral surface intimately fit in bottom and inner peripheral surfaces of said fitting recess of said connector housing, said seal member being provided with ridges and apertures on the surfaces in contact with said cylindrical contact receptacle walls, and said ridges being held in intimate contact with said cylindrical contact receptacle walls.

7. A waterproof electrical connector according to claim 5, wherein said contacts of said socket are press-on terminals.

8. A waterproof electrical connector according to claim 6, wherein said contacts of said socket are press-on terminals.

9. A multipolar connector including a female connector having a female housing for accommodating and supporting a plurality of first connecting terminals, a male connector having a male housing for accommodating and supporting a plurality of second connecting terminals each connectable to a corresponding one of said first connecting terminals, and a seal member positioned between opposing end faces of said female and male connectors when said female and male connectors are coupled to each other comprising:

an overlapping portion formed between and around individual connecting terminals on the end face of each of said female and male housings opposing each other through said seal member; and said seal being positioned adjacent to and extending along said overlapping portions on said female and male housings for sealing off the adjacent individual connecting terminals independently of each other when said female and male housings are coupled to each other.

* * * * *